US006542715B2

(12) United States Patent
Miyamoto et al.

(10) Patent No.: US 6,542,715 B2
(45) Date of Patent: Apr. 1, 2003

(54) IMAGE FORMING APPARATUS AND EJECTED SHEET STACKING DEVICE FOR USE THEREWITH

(75) Inventors: Tarou Miyamoto, Hachioji (JP); Naoki Otomo, Hachioji (JP); Takeshi Sakabe, Hachioji (JP); Hideo Isohara, Hachioji (JP); Takeshi Suzuki, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/023,956

(22) Filed: Dec. 17, 2001

(65) Prior Publication Data

US 2002/0081134 A1 Jun. 27, 2002

(30) Foreign Application Priority Data

Dec. 26, 2000 (JP) ..... 2000/395783

(51) Int. Cl.[7] ..... G03G 15/00

(52) U.S. Cl. ..... 399/405; 270/58.08; 399/107; 399/407

(58) Field of Search ..... 271/279, 288; 399/816, 82, 107, 381, 382, 403, 404, 407, 408, 405

(56) References Cited

U.S. PATENT DOCUMENTS 6,381,442 B1 * 4/2002 Okitsu et al. ..... 399/405
6,393,232 B1 * 5/2002 Osari et al. ..... 399/82

* cited by examiner

*Primary Examiner*—Hoang Ngo
(74) *Attorney, Agent, or Firm*—Muserlian, Lucas and Mercanti

(57) ABSTRACT

In an ejected sheet stacking device for use in an image forming apparatus provided with a sheet ejection part formed in a hollow place formed so as to open to an outer housing of the image forming apparatus and with a sheet storing mechanism for storing sheets ejected from a sheet ejection opening of the image forming apparatus, the ejected sheet stacking device comprising: a plurality of sheet storing trays arranged in a multi-stage way in a vertical direction; an ejecting and conveying mechanism for conveying a sheet ejected from the sheet ejection opening of the image forming apparatus to one of the sheet storing trays; and a conveyance path switching mechanism for switching a bifurcating conveyance path which bifurcates the sheet ejected from the sheet ejection opening to lead to each of the sheet storing trays. The ejected sheet stacking device is mounted to the image forming apparatus in place of the sheet storing mechanism.

5 Claims, 6 Drawing Sheets

IMAGE FORMING APPARATUS AND EJECTED SHEET STACKING DEVICE FOR USE THEREWITH

BACKGROUND OF THE INVENTION

This invention relates to an image forming apparatus and an ejected sheet stacking device which is selectively used in this image forming apparatus.

At present, what is called a multi-function machine, that is, an image forming apparatus having a copying function, a facsimile function, and a printer function is broadly utilized.

For such an image forming apparatus, from the view point of making small the occupied area for installation for example, it has been known such one employing so-called an inner tray method that is provided with a sheet ejection part formed in a hollow place to open to the outside through the outer housing and is also provided with a sheet storing mechanism for storing sheets in this sheet ejection part.

FIG. 6 is an illustration showing in broad outline an example of the structure of an image forming apparatus employing a conventional inner tray method as seen from the front direction. This image forming apparatus 60 has a sheet ejection part 63 formed in a hollow place 62 which is formed in such a manner as to open to the outside through the front surface (the surface parallel to the paper surface in the drawing) of the outer housing 61 and through the one side surface (the right-hand side surface in the drawing), and in this sheet ejection part 63, a sheet storing mechanism 63A for storing sheets ejected from a sheet ejection opening is provided.

In the outer housing 61, there are arranged an image formation part 65 for practicing image formation on the basis of original image information which has been read by a document scanning part 64, and a paper feed unit 66 storing sheets to be fed to this image formation part 65, in the state that they are arrayed in the up-and-down direction. In this drawing, 67 denotes a conveyance part for conveying sheets such as plain paper sheets for example, and 68 denotes a fixing part for fixing a toner image formed on a sheet.

In this image forming apparatus 60, a sheet having a visible image formed in the image formation part 65 is conveyed by the conveyance part 67 in the horizontal direction under the hollow place 62, and is subjected to fixing processing in a fixing part 68; then, it is conveyed upward through an upward-extending conveyance path 70, and is ejected from the sheet ejection opening by ejection rollers 71, to be contained in the sheet storing mechanism 63A.

Generally speaking, in such an image forming apparatus, from the viewpoint of improving productivity and convenience, for example, there are not a few cases where it is required a sorting process for classifying ejected sheets into sheets ejected during the use of the copying function and sheets ejected during the use of the facsimile or printer function.

However, in an image forming apparatus having the above-mentioned structure, even though a hollow place 62 of a sufficient size is not secured, it is necessary to provide a plurality of sheet storing mechanisms, which lowers the sheet storing capacity of each sheet storing mechanism, and also makes it difficult to take out sheets contained in said sheet storing mechanism, to lower the productivity and convenience instead.

For such a problem, as shown in FIG. 7, there is an apparatus having a structure with its large height size to secure the hollow place 62 of a sufficient size, and being provided with a reception and print sheet storing part 69A composed of a sheet storing mechanism, a tray for example, for storing sheets ejected during the use of the facsimile or printer function, and a copy sheet storing part 69B which is a sheet storing mechanism for storing sheets ejected during the use of the copying function.

The sheet conveyance path 70 in this image forming apparatus 60A has a bifurcation path 70A leading to the reception and print sheet storing part 69A and a bifurcation path 70B leading to the copied sheet storing part 69B, and a switching guide 72 is provided at the bifurcation point.

However, in this image forming apparatus 60A, even in cases where the copying function is not used, the bifurcation path 70B leading to the copy sheet ejection part 69B has been formed beforehand in the mainframe of the image forming apparatus 60A, which increases the manufacturing cost accompanied by the increase of the number of the component parts and makes the whole of the apparatus large-sized; therefore, it is unreasonable for a user who does not use the sorting function provided in the image forming apparatus 60A for some reasons.

SUMMARY OF THE INVENTION

This invention has been made on the basis of the above-mentioned things, and it is its object to provide an image forming apparatus whose function a user can freely intend to diversify.

It is another object of this invention to provide an image forming apparatus which has a large capacity for storing sheets of each sheet storing tray and makes it possible to take out the contained sheets easily when an ejected sheet stacking mechanism is selectively mounted to the image forming apparatus.

It is further object of this invention to provide a new ejected sheet stacking device to be selectively mounted to an image forming apparatus of this invention.

The objects of this invention can be accomplished by any one of the structures described below.

(1) An image forming apparatus of this invention is an image forming apparatus having a sheet ejection part formed in a hollow place formed in such a manner as to open to the outside through the outer housing and being provided with a sheet storing mechanism for storing sheets ejected from a sheet ejection opening in such a way that it is able to be mounted and dismounted, characterized in that an ejected sheet stacking device can be mounted in the sheet ejection part instead of the sheet storing mechanism, and said ejected sheet stacking device is provided with a plurality of sheet storing trays arranged in a multi-stage way in the vertical direction, an ejecting and conveying mechanism for conveying a sheet from said sheet ejection opening to one of said sheet storing trays, and a conveyance path switching mechanism for switching a bifurcating conveyance path which bifurcates in such a manner as to lead to each of said sheet storing trays from said sheet ejection opening.

In an image forming apparatus of this invention, it is desirable that the hollow place formed in such a manner as to open to the outside through the outer housing comprises a first space portion succeeding to the sheet ejection opening and a second space portion succeeding to this first space portion in the sheet ejecting direction, and the level of the bottom surface of the second space portion is lower than the level of the bottom surface of the first space portion; in this case, it is desirable that the ejected sheet stacking device is mounted in a state where each of the sheet storing trays is positioned in the second space portion in said hollow place.

(2) An image forming apparatus of this invention is an image forming apparatus having a sheet ejection part formed in a hollow place formed in such a manner as to open to the outside through the outer housing and being provided, in said sheet ejection part, with a sheet storing mechanism for storing sheets ejected from a sheet ejection opening, in such a way that it is able to be mounted and dismounted, characterized in that an ejected sheet stacking device can be mounted in the sheet ejection part instead of the sheet storing mechanism, said ejected sheet stacking device is provided with a plurality of sheet storing trays arranged in a multi-stage way in the vertical direction, an ejecting and conveying mechanism for conveying a sheet from said sheet ejection opening to one of said sheet storing trays, and a conveyance path switching mechanism for switching a bifurcating conveyance path which bifurcates in such a manner as to lead to each of said sheet storing trays from said sheet ejection opening, and an ejected sheet stacking device of a second stage having the same structure as said ejected sheet stacking device can be mounted instead of a sheet storing tray corresponding to one of the bifurcation paths in said ejected sheet stacking device.

In the above-mentioned image forming apparatus, it is desirable that the hollow place formed in such a manner as to open to the outside through the outer housing comprises a first space portion succeeding to the sheet ejecting part and a second space portion succeeding to this first space portion in the sheet ejecting direction, both being formed in a state where the bottom surface of the second space portion is lower than the bottom surface of the first space portion, and the first-stage ejected sheet stacking device is mounted utilizing the first space portion, while the second-stage ejected sheet stacking device is mounted utilizing the second space portion.

(3) Further, an image forming apparatus of this invention is an image forming apparatus having a sheet ejection part formed in a hollow place formed in such a manner as to open to the outside through outer housing and being provided, in said sheet ejection part, with a sheet storing mechanism for storing sheets ejected from a sheet ejection opening, in such a way that it is able to be mounted and dismounted, characterized in that an ejected sheet stacking device can be mounted instead of said sheet storing mechanism through an opening for mounting formed by cutting off the protective cover portion of the inner wall partitioning said hollow place from said inner wall, and said ejected sheet stacking device is provided with a plurality of sheet storing trays arranged in a multi-stage way in the vertical direction, an ejecting and conveying mechanism for conveying a sheet from said sheet ejection opening to one of said sheet storing trays, and a conveyance path switching mechanism for switching a bifurcating conveyance path which bifurcates in such a manner as to lead to each of said sheet storing trays from said sheet ejection opening.

(4) An ejected sheet stacking device of this invention is provided with a plurality of sheet storing trays arranged in a multi-stage way in the vertical direction, an ejecting and conveying mechanism for conveying a sheet from the sheet ejection opening of an image forming apparatus to one of said sheet storing trays, and a conveyance path switching mechanism for switching a bifurcating conveyance path which bifurcates in such a manner as to lead to each of said sheet storing trays from said sheet ejection opening, and is characterized in that, for an image forming apparatus having a sheet ejection part formed in a hollow place to open to the outside through the outer housing and being provided, in said sheet ejection part, with a sheet storing mechanism for storing sheets ejected from said sheet ejection opening, said ejected sheet stacking device is mounted instead of said sheet storing mechanism.

In an ejected sheet stacking device of this invention, it is desirable that it is provided in each of the sheet storing trays a auxiliary tray which is capable of being inserted and drawn out in the direction of entering sheets.

Further, it is desirable that an ejected sheet stacking device of this invention is mounted through an opening for mounting which is formed in the inner wall partitioning a hollow place of an image forming apparatus so as to expose the portion to be connected to the ejected sheet stacking device, and is provided with a holding portion for holding a cover member for stopping said opening for mounting which is left behind after said ejected sheet stacking device is dismounted from the image forming apparatus.

By employing an image forming apparatus having the above-mentioned structure (1), because an ejected sheet stacking device provided with a plurality of sheet storing trays and a switching mechanism can be alternatively mounted instead of a sheet storing mechanism, a user can intend to diversify the function of the image forming apparatus freely as the occasion demands.

Further, because an ejecting and conveying mechanism, a bifurcating conveyance path, and a switching mechanism are provided in the ejected sheet stacking device to be mounted, it is unnecessary to provide component parts for sorting processing in the mainframe of the image forming apparatus, and the manufacturing cost can be reduced by this, which makes the apparatus useful also for a user who does not need a sorting function.

Further, in the case where the above-mentioned ejected sheet stacking device provided with a plurality of trays and a switching mechanism is mounted instead of the sheet storing mechanism in the sheet ejection part, for example, copy sheets ejected during the use of the copying function, and reception and print sheets ejected during the use of the facsimile function etc. can be certainly contained in different sheet storing trays respectively, without the mixed presence of the both kinds of sheets.

Further, in the case where the hollow place formed in the outer housing has a first space portion and a second space portion whose bottom surface level is lower than that of the first space portion, by mounting an ejected sheet stacking device in such a way that the sheet storing trays arranged in a multi-stage way are positioned in the second space portion, the distance between the sheet storing trays can be made large, which makes it possible to raise the sheet storing capacity of each sheet storing trays, and also makes it possible to take out the contained sheets easily.

Further, by employing an image forming apparatus having the above-mentioned structure (2), in a state where a first-stage ejected sheet stacking device is mounted in the hollow place, a second-stage ejected sheet stacking device can be further mounted; therefore, the number of sheet storing trays can be increased as the occasion demands, and on top of it, because the second-stage ejected sheet stacking device can be mounted substantially in the hollow place, the occupied area for installation never becomes broader by a large margin.

Further, by employing an image forming apparatus having the above-mentioned structure (3), in the case where an ejected sheet stacking device is not mounted, the connection part for the ejected sheet stacking device is covered with a protective cover portion of the inner wall partitioning the hollow place; therefore, said connection part is protected, and in the case where an ejected sheet stacking device is mounted, because the connection part is exposed through the formation of an opening for mounting by cutting off the protective cover portion, only it is necessary to connect the ejected sheet stacking device through inserting it into the hollow place, which makes it possible to mount the device very easily.

Further, in the case where an ejected sheet stacking device has once been mounted, and then it is to be dismounted for some reasons, because a cover member for stopping the opening for mounting is provided at the holding portion in the ejected sheet stacking device, it never occurs that the cover member is lost, which makes it possible to certainly protect the connection part.

DETAILED DESCRIPTION OF THE PREFERRED EMBODIMENT

In the following, with reference to the drawings, this invention will be explained in detail.

Figure 1:
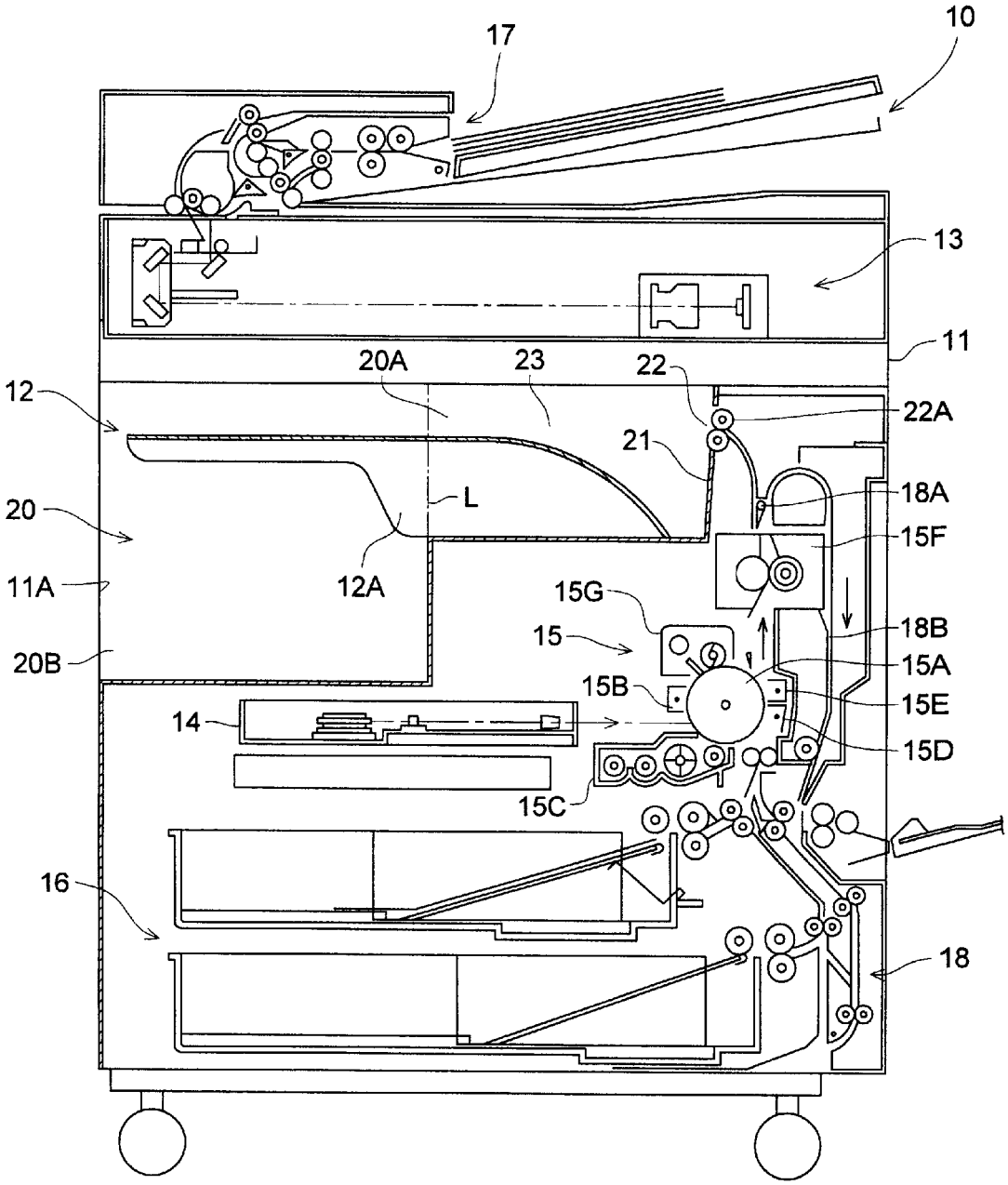
FIG. 1 is a cross-sectional view for explanation as seen from the front direction showing an example of the outline structure of an image forming apparatus of this invention.

FIG. 1 is a cross-sectional view as seen from the front direction showing in broad outline an example of practice of an image forming apparatus of this invention. This image forming apparatus 10 is one employing what is called a inner tray method; to state it concretely, a sheet ejection part 12 is formed in a hollow place 20 formed in such a manner as to open to the outside through the front surface (the surface parallel to the paper surface in the drawing) of the outer housing 11 and through one of the side surfaces (left side surface in the drawing), and in this sheet ejection part 12, a sheet storing mechanism 12A consisting of a single tray is mounted in such a manner as to be able to be mounted and dismounted.

In the outer housing 11, a document image reading part 13 for reading an original image through optically scanning a document to obtain image data is arranged above the hollow place 20, while under the hollow place 20, there are arranged an image writing part 14 for forming an electrostatic latent image on a drum-shaped photoreceptor 15A in an image forming part 15 on the basis of image data from the document image reading part 13, the image forming part 15, which is positioned at the other side part of the outer housing 11 in such a manner as to come in line with this image writing part 14 in the horizontal direction, for making visible the electrostatic latent image on the photoreceptor 15A, a nd a paper feed unit 16 positioned under the image writing part 14 for storing sheets as image recording materials. In the drawing, 17 denotes an automatic document feeding mechanism provided on the upper surface of the outer housing 11, and 18 denotes an inversion conveyance mechanism, which is one for conveying a sheet having a visible image formed on its one side again to the image forming part 15 with the other side made to face left.

The image forming part 15 is composed of the drum-shaped photoreceptor 15A, a charging part 15B for charging said photoreceptor 15A, a developing device 15C for forming a toner image by making the electrostatic latent image formed on the photoreceptor 15A a visible image, a transfer part 15D for transferring the toner image formed on the photoreceptor 15A to a sheet, a detaching part 15E for detaching the sheet closely adhering to the photoreceptor 15A, a fixing part 15F for fixing t he toner image transferred to the sheet, and a cleaning part 15G for removing the toner particles remaining on the surface of the photoreceptor 15A, and has a structure such that a sheet leaving the paper feed unit 16 is conveyed upward.

With respect to the inner wall for partitioning the hollow place 20, in the inner wall part 21 opposite to the opening 11A formed on one side surface of the outer housing 11, a sheet ejection opening 22 for ejecting a sheet, for which a process such as an image forming process has been finished, to the sheet ejection part 12 is formed, and close to this sheet ejection opening 22, a pair of ejection rollers 22A are provided.

The hollow place 20 comprises a first space portion 20A succeeding to the sheet ejection opening 22 and a second space portion 20B which is partitioned by a partitioning line L shown by the single dot and dash line in the drawing and succeeds to the first space portion 20A in such a manner as to be positioned side by side with it to the sheet ejecting direction (the left direction in the drawing), and the bottom surface level of the second space portion 20B is made lower than that of the first space portion. In addition, it is desirable that the difference of the bottom surface levels between the first space portion 20A and the second space portion 20B is 50 mm or over, for example. By doing this, the distance between the sheet storing trays in the ejected sheet stacking device to be described later can be made sufficiently large, which makes it possible to take out the contained sheets easily.

Figure 2:
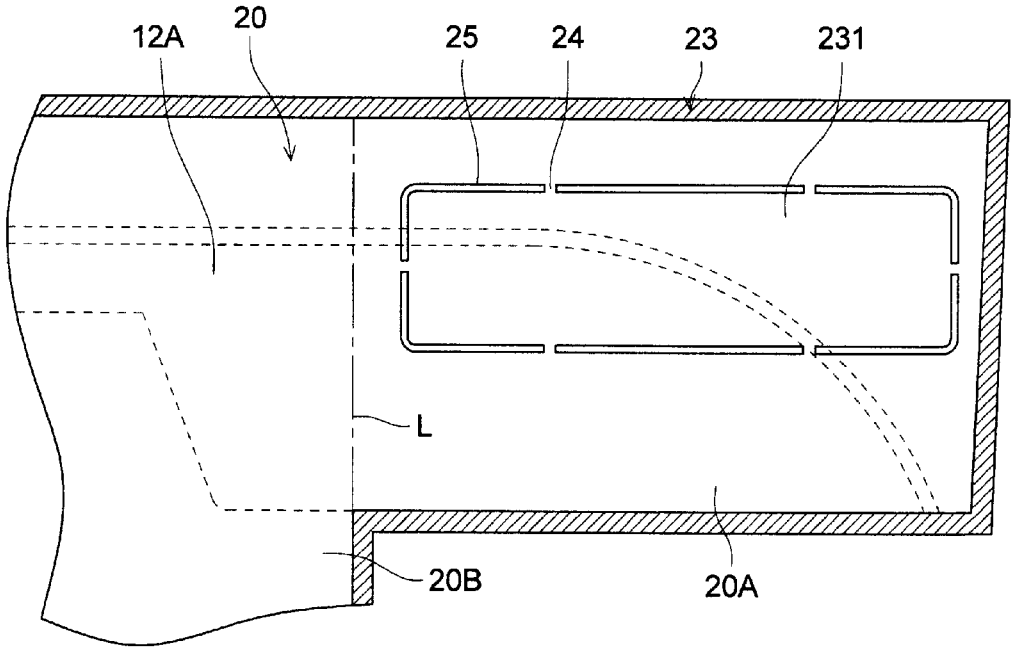
FIG. 2 is an illustration showing the inner wall partitioning the hollow place in the image forming apparatus shown in FIG. 1.

In respect of the inner wall 23, which partitions the hollow place 20 and is opposite to the opening formed in the front surface of the outer housing 11, in the area forming the first space portion 20A, as shown in FIG. 2, it is formed a protective cover portion 231 for covering a connection part composed of a driving force transmitting portion and a drive control system for supplying a driving force to the ejected sheet stacking device. To state it concretely, in the inner wall 23 consisting of a single plate member, by forming a slot 25 along the periphery of a rectangular area covering the connection part with the linking portions 24 to be cut off left not removed, the protective cover portion 231 is formed.

Next, the operation of this image forming apparatus will be explained.

First, reading of an original image is carried out by the document image reading part 13, an electrostatic latent image is formed on the photoreceptor 15A by the image writing part 15B on the basis of this original image information, and by making visible this electrostatic latent image by the developing device 15C, a toner image is formed on the surface of the photoreceptor 15A. Then, in the transfer part 1SD, the toner image is transferred to a sheet having been conveyed from the paper feed unit 16, and after the sheet which is in a state of closely adhering to the photoreceptor 15A is detached from the photoreceptor 15A in the detaching part 15E, the sheet is conveyed to the fixing part 15F where it is subjected to fixing processing; after that, the sheet is ejected by the ejection rollers 22A from the ejection opening 22, and is contained in the sheet storing mechanism 12A.

Further, in the case where an image is formed on each of the both sides of a sheet, by a guide 18A of an inversion-conveying mechanism 18 arranged at the downstream of the fixing part 15F in the sheet conveying direction, the sheet coming from the fixing part 15F is fed to the inversion-conveying path 18B, and the sheet having a visible image formed on its one side is conveyed again to the image forming part 15 with its other side made to face left. Then, in the same way as described in the above, after an image is formed on the other side of the sheet, the sheet is ejected from the sheet ejection opening 22 by the ejection rollers 22A, to be contained in the sheet storing mechanism 12A.

In the above-mentioned image forming apparatus, it is employed a structure such that it can be mounted an ejected sheet stacking device provided with a plurality of sheet storing trays and a switching mechanism alternatively for the sheet storing mechanism 12A consisting of a single sheet storing tray provided in the sheet ejection part 12, that is, instead of the sheet storing mechanism 12A.

To state it concretely, in order to mount the ejected sheet stacking device, after the sheet storing mechanism 12A is dismounted, only it is necessary that, by cutting the linking portions 24 for cutting off in the inner wall 23 partitioning the hollow place 20 with a tool such as a nipper, an opening for mounting is formed to expose the connection part, and in this state, an ejected sheet stacking device is mounted by an operation to insert it into the hollow place 20 from the front side to connect it with the connection part.

Figure 3:
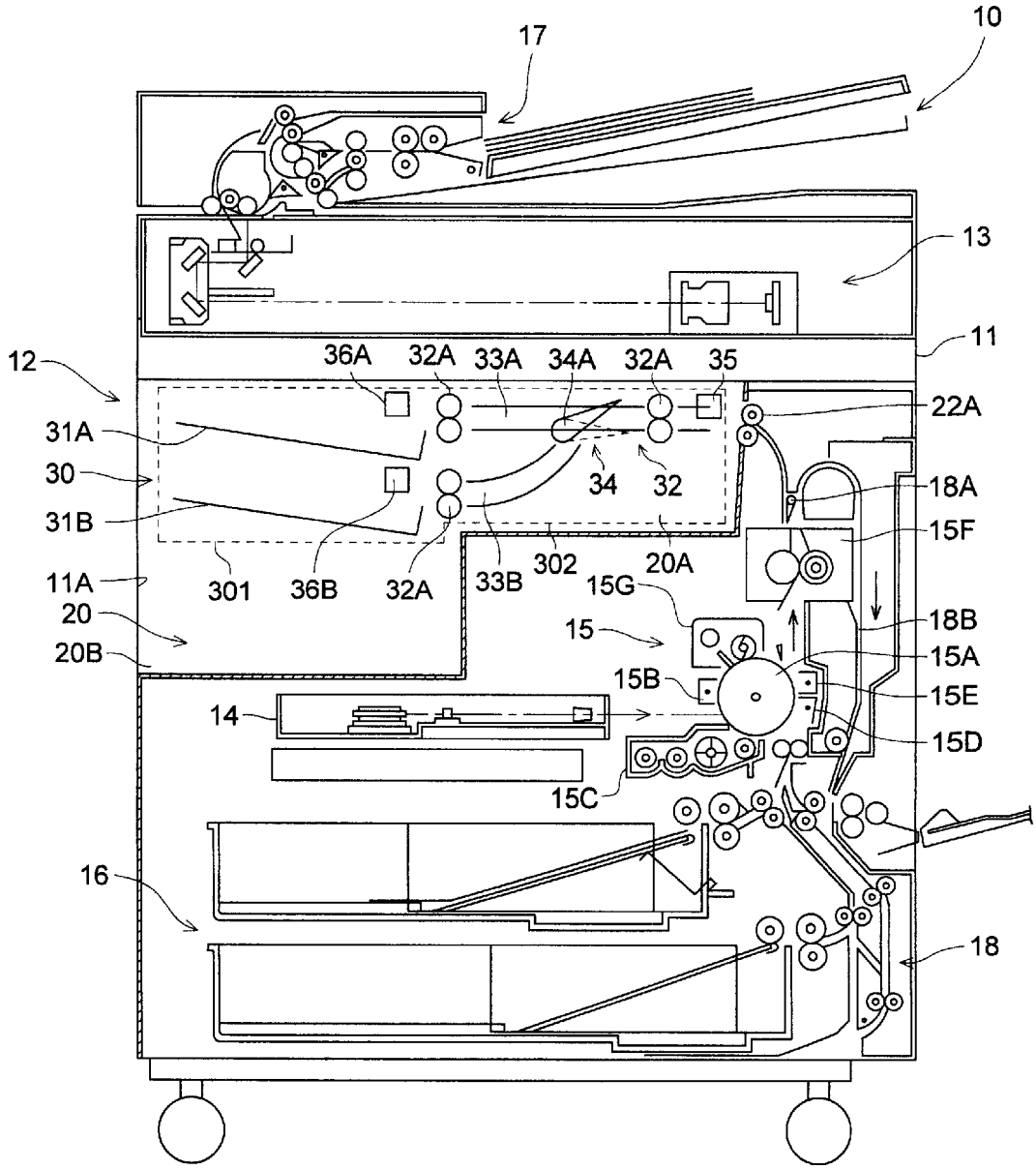
FIG. 3 is a cross-sectional view for explanation showing a state where an ejected sheet stacking device is mounted in the image forming apparatus shown in FIG. 1.

FIG. 3 is a cross-sectional view for explanation showing a state where an ejected sheet stacking device is mounted instead of a sheet storing mechanism in the image forming apparatus shown in FIG. 1.

The ejected sheet stacking device 30 to be mounted instead of the sheet storing mechanism 12A is composed of a sheet placing portion 301 consisting of a sheet storing trays 31A and 31B, which are arranged in a multi-stage way, two-stage for example, in the vertical direction and a sheet ejection-conveying portion 302, and the sheet ejection-conveying portion 302 is provided with an ejecting and conveying mechanism 32 for conveying a sheet from the sheet ejection opening 22 in the mainframe of the image forming apparatus 10 to the sheet storing tray, and a conveyance path switching mechanism 34 for switching the conveyance pathway between the bifurcation conveyance paths leading to the respective sheet storing trays 31A and 31B from the sheet ejection opening 22. Further, the sheet ejection-conveying portion 302 of the ejected sheet stacking device 30 is disposed in the first space portion 20A in the hollow place 20, while sheet placing portion 301 is disposed in the second space portion 20B in the hollow place 20.

The ejecting and conveying mechanism 32 is provided with a plurality of pairs of the ejection-conveying rollers which consist of a group of pinch rollers (32B in FIG. 4) provided at a plurality of positions separated from one another in the width direction of sheets to be conveyed.

Further, at the sheet entrance through which a sheet from the sheet ejection opening 22 of the image forming apparatus 10 enters first space portion, a sensor 35 for detecting that the leading edge of a sheet have passed is provided, while in the sheet storing trays 31A and 31B, ejection sensors 36A and 36B for detecting that a sheet is ejected are provided respectively.

The conveyance path switching mechanism 34 is composed of a bifurcation guide 34A and a solenoid (not shown in the drawing) which is a drive means for driving this bifurcation guide 34A, and by the bifurcation guide 34A being driven, the switching of the pathway to be used is carried out between the bifurcation path 33A leading to the upper sheet storing tray 31A and the bifurcation path 33B leading to the lower sheet storing tray 31B.

Figure 4:
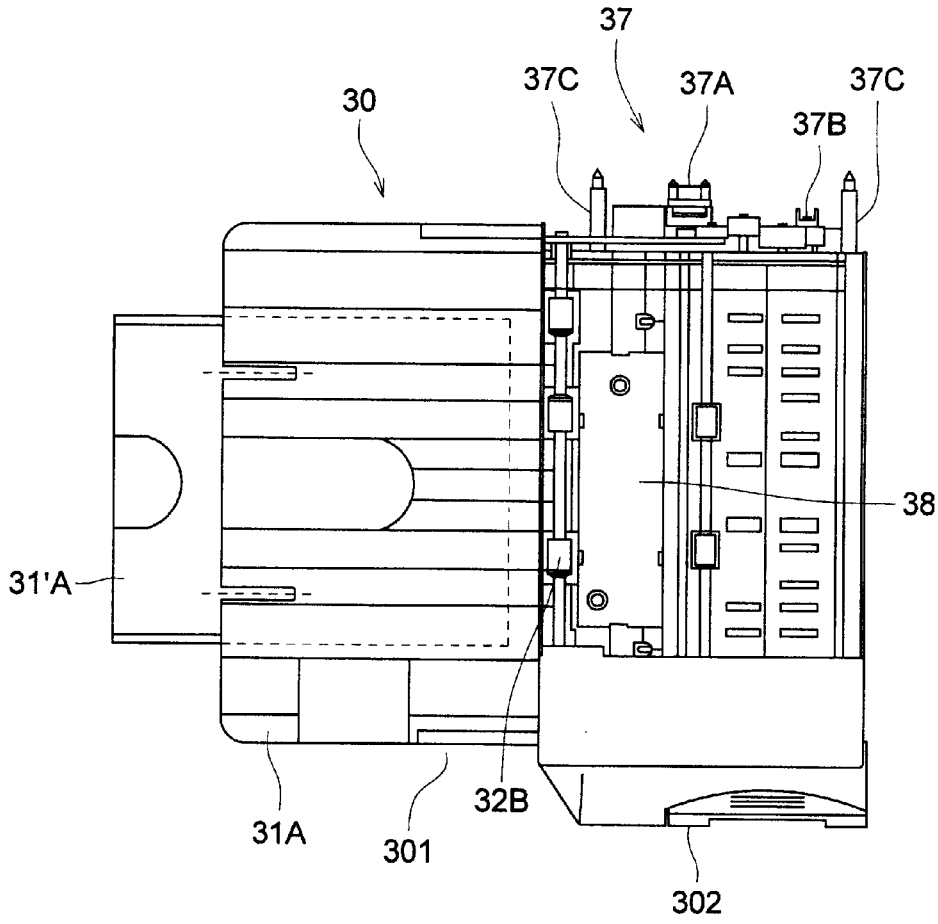
FIG. 4 is the top view showing an example of the structure of an ejected sheet stacking device.

Under the upper sheet storing tray 31A, it is provided an auxiliary tray 31A supported by a supporting rail extending in the direction of entering sheet (horizontal direction in FIG. 3) in such a manner as to be able to project and retract, and in accordance with the size of sheets to be contained, the size of the sheet placing portion 301 can be adjusted by drawing out the auxiliary tray in the direction of entering sheet. Moreover, concerning the lower sheet storing tray 31B, the same structure is employed In the ejected sheet stacking device 30, as shown in FIG. 4, on the rear side of the sheet ejection-conveying portion 302 (the side positioned above in FIG. 4), it is provided a connection part 37 to be connected to the connection part of the image forming apparatus; to state it concretely, there are provided a connector portion 37A to be connected to the drive control system in the connection part of the image forming apparatus 10, a drive means 37B consisting of, for example, a coupling gear to be connected to the driving force transmitting portion of the connection part of the image forming apparatus 10, and two pin members for determining the position of projection from the rear side of the sheet ejection-conveying portion 302 toward the outside (upper direction).

At the center of the sheet ejection-conveying portion 302 of this ejected sheet stacking device 30, there is provided a cover member holding portion for holding a cover member for stopping the opening for mounting formed in the hollow place 20 of the image forming apparatus 10, and in this holding portion, a cover member 38 is provided fixedly with a fixing member such as a screw for example.

Further, the cover member 38 is dismounted from the ejected sheet stacking device 30 and is used in the case where said ejected sheet stacking device is dismounted for some reasons, for example, in the case where a large-sized after-processing apparatus is attached instead of it, in the case where the previously attached sheet storing mechanism 12A is again used instead of it, or in the other like cases.

Now, to explain the operation of the above-mentioned ejected sheet stacking device 30, first, in respect of the image forming apparatus 10, when the ejected sheet stacking device 30 is mounted in the hollow place 20, the control program for switching the sheet storing tray between the trays 31A and 31B for every image formation process is practiced. Further, when it has been detected by the entrance sensor 35 that the leading edge of a sheet from the sheet ejection opening 22 of the mainframe of the image forming apparatus 10 has passed, the bifurcation guide 34A in the conveyance path switching mechanism 34 is driven, to select either one or the other of the bifurcation conveyance paths, and the sheet is ejected by the ejection-conveying rollers 32, to be contained in the predetermined sheet storing tray. In this way, sheets in each of image formation processes, for example, copy sheets ejected during the use of the copying function and reception and print sheets ejected during the use of the facsimile function etc. can be contained in the respective sheet storing trays without the mixed presence of the both kinds of sheets.

Further, in the image forming apparatus 10 of this invention, in the state where the first-stage ejected sheet stacking device 30 is mounted instead of the sheet storing mechanism 12A in the sheet ejection part 12, instead of the lower sheet storing tray 31B in the first-stage ejected sheet stacking device 30 further, a second-stage ejected sheet stacking device having the same basic structure as the first-stage ejected sheet stacking device can be mounted.

Figure 5:
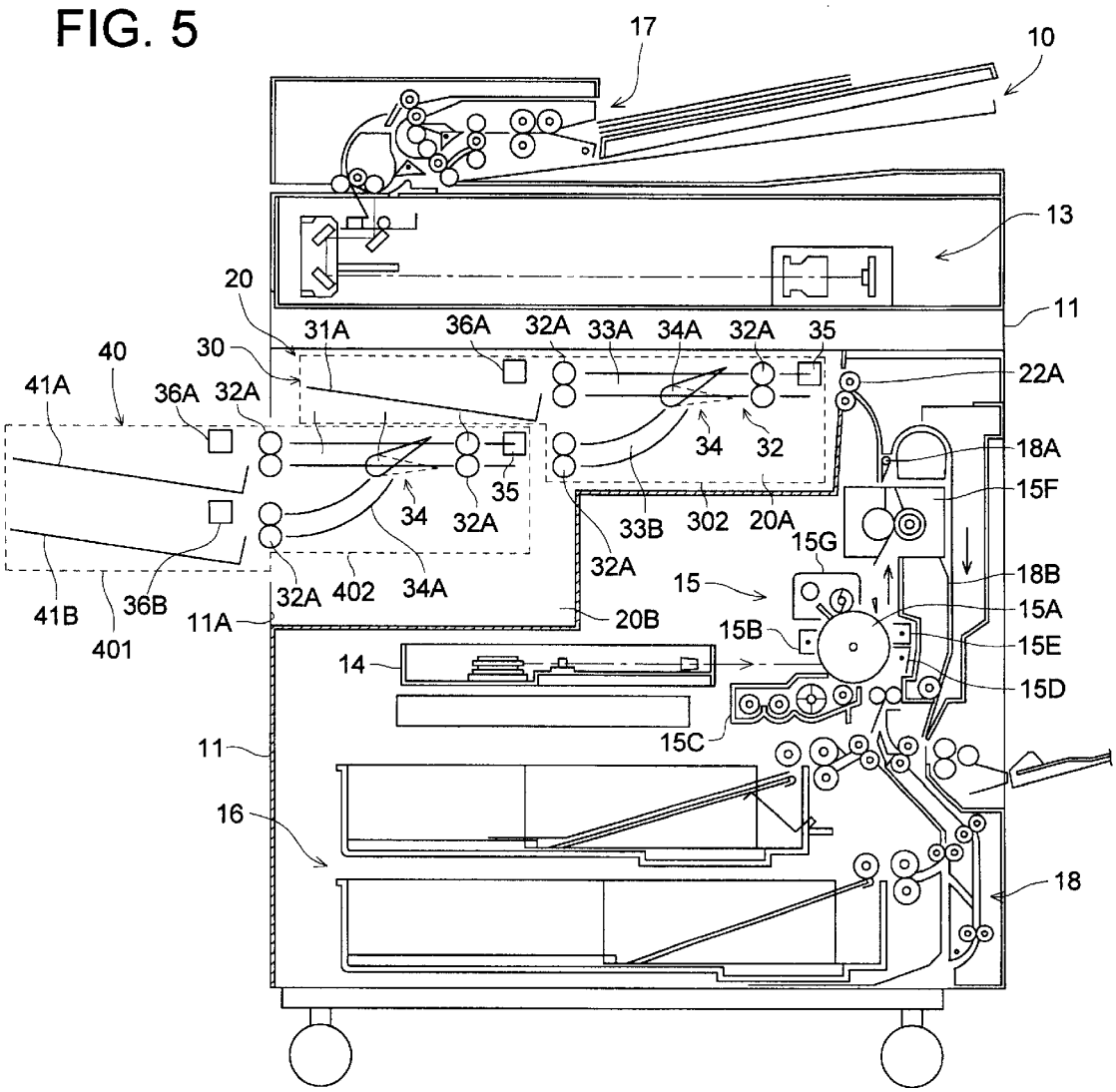
FIG. 5 is a cross-sectional view for explanation showing a state where, in an image forming apparatus having an ejected sheet stacking device mounted, a second-stage ejected sheet stacking device is mounted successively to one of the bifurcation paths of said ejected sheet stacking device.
Figure 6:
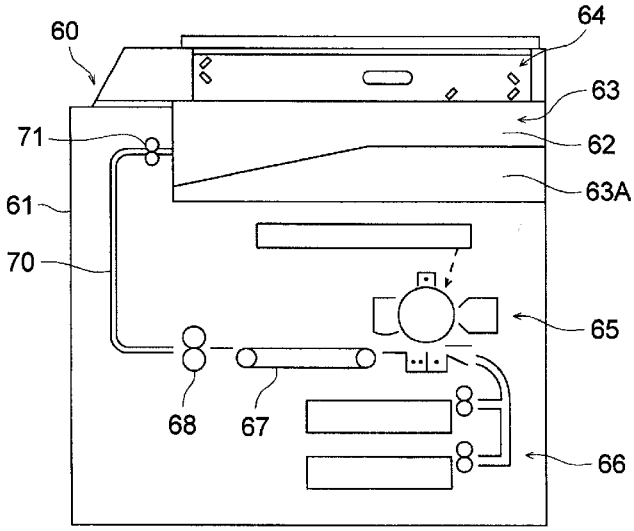
FIG. 6 PRIOR ART
FIG. 6 is a cross-sectional view for explanation showing in broad outline an example of the structure of an image forming apparatus employing a conventional inner tray method.
Figure 7:
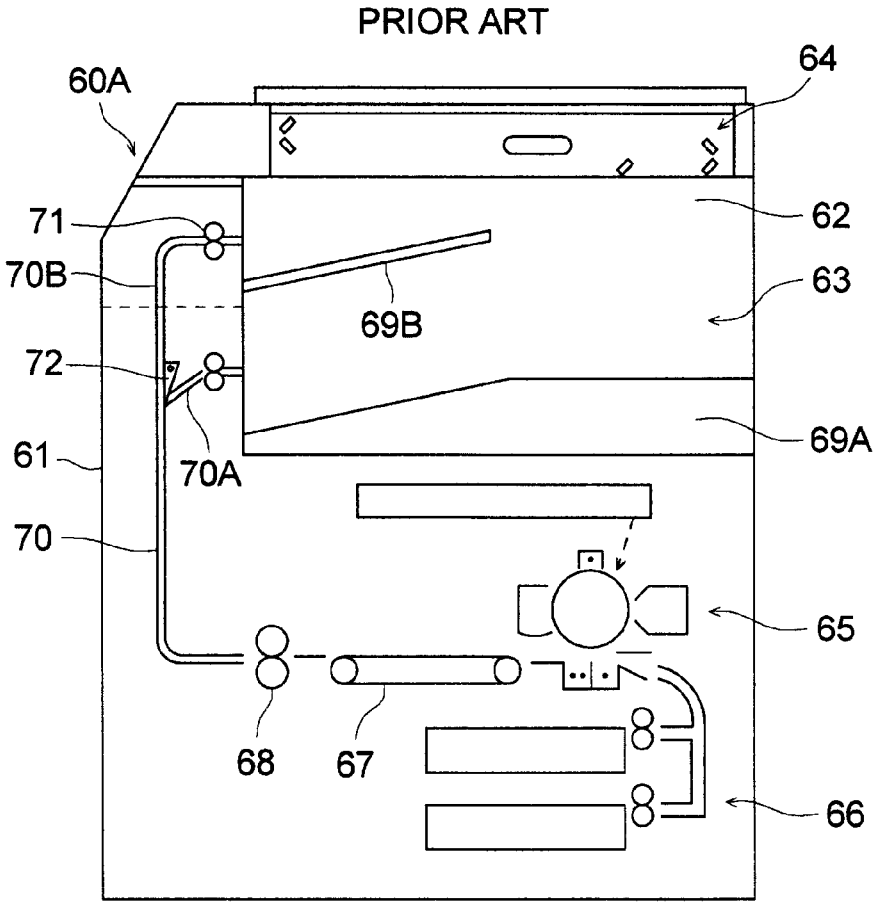
FIG. 7 is a cross-sectional view for explanation showing in broad outline another example of the structure of an image forming apparatus employing a conventional inner tray method.

As shown in FIG. 5, the second-stage ejected sheet stacking device 40 is arranged in the state where it is contained substantially in the hollow place 20 of the image forming apparatus, to state it concretely, in the state where the sheet ejection-conveying portion 402 of the second-stage ejected sheet stacking device 40 is disposed in the second space portion 20B in the hollow place 20, and the sheet placing portion 401, which consists of a plurality of sheet storing trays 41A and 41B arranged vertically in a multi-stage way, projects out of the hollow place 20.

By employing the image forming apparatus 10 as stated in the above, because it is possible to mount in it the ejected sheet stacking device 30 having the plural sheet storing trays 31A and 31B and the conveyance path switching mechanism 34 instead of the single sheet storing mechanism 12A, a user himself can intend to diversify the function of the image forming apparatus 10 freely as the occasion demands.

Further, because the ejected sheet stacking device 30 to be mounted is provided with the ejecting and conveying mechanism 32, the bifurcation conveyance paths 33A and 33B, and the conveyance path switching mechanism 34, it is unnecessary to provide component parts for sorting processing in the mainframe of the image forming apparatus 10, which makes it possible to reduce the manufacturing cost; thus, this invention can be useful also for a user who does not need a sorting function.

Further, in the case where the ejected sheet stacking device having the plural sheet storing trays 31A and 31B and the conveyance path switching mechanism 34 is mounted instead of the single sheet storing mechanism 12A, as the result that two sheet storing trays are used under the condition of switching control, for example, copy sheets ejected during the use of the copying function, and the reception and print sheets ejected during the use of the facsimile function etc. can be contained certainly in the different sheet storing trays 31A and 31B respectively, without the mixed presence of the two kinds of sheets, which makes it possible to improve the productivity and the convenience.

Further, in respect of the above-mentioned image forming apparatus 10, because the image forming part 15 is arranged at the other side (right-hand side in the drawing) opposite to the one side where the opening 11A is formed, in a state where sheets are to be conveyed upward, it is possible to form the hollow place 20 in a multi-stage way having the first space portion and the second space portion with their bottom surface levels made different to each other. Hence, by mounting the ejected sheet stacking device 30 in such a way as to make the sheet placing portion 301, which is composed of the plural sheet storing trays 31A and 31B arranged in a multi-stage way, positioned in the second space portion 20B having a broader space domain, the distance between the sheet storing trays 31A and 31B can be made broader, which makes it possible to raise the sheet storing capacity of each of the sheet storing trays 31A and 31B, and also makes it possible to easily take out the sheets contained.

Further, in the above-mentioned image forming apparatus 10, in the state where the first-stage ejected sheet stacking device 30 is mounted in the hollow place 20, it is possible to mount the second-stage ejected sheet stacking device 40 further, succeeding to the bifurcation conveyance path 33B in the first-stage ejected sheet stacking device 30; therefore, it is possible to increase the number of the sheet storing trays that can be used alternatively by switching, and on top of it, because the second-stage ejected sheet stacking device can be contained substantially in the hollow place 20, the occupied area for installation is never made broader by a large margin.

Further, by employing the above-mentioned image forming apparatus 10, in the case where ejected sheet stacking device 30 is not mounted, because the connection part for the ejected sheet stacking device 30 is covered with the protective cover portion 231 of the inner wall 23 partitioning the hollow place 20, said connection part is protected, and in the case where the ejected sheet stacking device is mounted, the opening for mounting is formed to expose the connection part by cutting off the protective cover portion 231; therefore, only it is necessary to insert the ejected sheet stacking device into the hollow place 20 from the front side to connect it with the connection part, which makes it possible to mount the device extremely easily.

Further, because the cover member 38 for stopping the opening for mounting formed in the hollow place 20 is provided in the cover member holding portion of the ejected sheet stacking device 30, when the ejected sheet stacking device 30 that has once been mounted is dismounted for some reasons of a user, the cover member 38 is prevented from being lost, which makes it possible to protect the connection part certainly. On top of it, before the cover member 38 is detached, the lead wires connected to the entrance sensor 35 and the ejection sensors 36A and 36B, and the sensors themselves can be protected by said cover member 38, while also it is possible to make the cover member function as the handle of the ejected sheet stacking device 30.

Up to now, the embodiment of this invention has been explained; this invention should not be limited to the above-mentioned embodiment, but various modifications may be added to it.

(1) In an image forming apparatus of this invention, because the ejected sheet stacking device is to be mounted alternatively, it is necessary that the opening for mounting is stopped until the ejected sheet stacking device is mounted, and at the time of mounting the ejected sheet stacking device, the opening for mounting is formed; the means for stopping the opening for mounting and the means for forming the opening for mounting should not be limited to the above-mentioned embodiment, but it may have a structure, for example, such that the opening for mounting is stopped by a protective cover composed of a member other than a part of the inner wall, and at the time of mounting the ejected sheet stacking device, the opening for mounting is formed by removing said protective cover, or it may have a structure such that a cover member is provided at the opening for mounting in such a way that it is able to be opened and closed, and the opening for mounting is stopped and formed by opening and closing this cover member. Actually, it is desirable that the protective cover portion is formed in such a way that it is able to be cut off as described in the above, for the reason that the reduction of cost can be achieved by making the number of parts smaller.

(2) Concrete points in the structure such as the number of the sheet storing trays making up the sheet placing portion of the ejected sheet stacking device and the length of the bifurcation path can be freely changed.

(3) The ejected sheet stacking device can practice not only a sorting processing for copy sheets ejected during the use of the copying function and the reception and print sheets ejected during the use of the facsimile function etc., but also a sorting processing or a collating processing in carrying out an image forming process for a plurality of copies by the copying function.

(4) It is possible to mount an after-processing device such as a binding processing device instead of mounting a second-stage ejected sheet stacking device; by mounting such an after-processing device, the function of an image forming apparatus can be further diversified.

By employing an image forming apparatus of this invention, because an ejected sheet stacking device having a plurality of sheet storing trays and a switching mechanism can be mounted alternatively instead of a sheet storing mechanism, a user himself can intend to diversify the function of the image forming apparatus freely as the occasion demands.

Further, because an ejected sheet stacking device to be mounted is provided with an ejecting and conveying mechanism, bifurcation paths, and a switching mechanism, it is unnecessary to provide component parts for sorting processing in the mainframe of the image forming apparatus, which makes it possible to reduce the manufacturing cost, and this invention can be useful also for a user who does not need a sorting function.

Further, in the case where, instead of the sheet storing mechanism in the sheet ejection part, the above-mentioned ejected sheet stacking device provided with a plurality of sheet storing trays and a switching mechanism has been mounted, for example, copy sheets ejected during the use of the copying function and the reception and print sheets ejected during the use of the facsimile function etc. can be certainly contained in the different sheet storing trays respectively without the mixed presence of the two kinds of sheets.

Further, in the case where the hollow place formed in the outer housing comprises a first space portion and a second space portion having the level of the bottom surface lower than that of the first space portion, by mounting an ejected sheet stacking device in such a way that the sheet storing trays arranged in a multi-stage way are positioned in the second space portion, the distance between the sheet storing trays can be made broader, which makes it possible to raise the sheet storing capacity of each of the sheet storing trays, and also makes it possible to easily take out the sheets contained.

By employing an image forming apparatus of this invention, in the state where a first-stage ejected sheet stacking device is mounted in the hollow place, a second-stage ejected sheet stacking device can be mounted further; therefore, it is possible to increase the number of the sheet storing trays as the occasion demands, and on top of it, the second-stage ejected sheet stacking device can be mounted substantially in the hollow place; therefore, the occupied area for installation is never made broader by a large margin.

By employing an image forming apparatus of this invention, in the case where an ejected sheet stacking device is mounted, because the opening for mounting is formed to expose the connection part by cutting off the protective cover portion of the inner wall partitioning the hollow place, only it is necessary to insert the ejected sheet stacking device into the hollow place to connect it with this connection part, which makes it possible to mount the device extremely easily.

By employing an ejected sheet stacking device of this invention, because it is provided with an ejecting and conveying mechanism, bifurcation paths, and a switching mechanism, for example, copy sheets ejected during the use of the copying function and reception and print sheets ejected during the use of the facsimile function etc. can be certainly contained in the different sheet storing trays respectively without the mixed presence of the both kinds of sheets, and on top of it, it is unnecessary to provide particular component parts for sorting processing in the mainframe of an image forming apparatus, which makes it possible to make the image forming apparatus mainframe small-sized, and also makes it possible to reduce the manufacturing cost.

What is claimed is:

1. An ejected sheet stacking device for use in an image forming apparatus provided with a sheet ejection part formed in a hollow place formed so as to open to an outer housing of the image forming apparatus and with a sheet storing mechanism for storing sheets ejected from a sheet ejection opening of the image forming apparatus, the ejected sheet stacking device comprising:

(a) a plurality of sheet storing trays arranged in a multi-stage way in a vertical direction;

(b) an ejecting and conveying mechanism for conveying a sheet ejected from the sheet ejection opening of the image forming apparatus to one of the sheet storing trays; and (c) a conveyance path switching mechanism for switching a bifurcating conveyance path which bifurcates the sheet ejected from the sheet ejection opening to lead to each of the sheet storing trays, wherein the ejected sheet stacking device is mounted to the image forming apparatus in place of the sheet storing mechanism which has been provided on the image forming apparatus.

2. The ejected sheet stacking device of claim 1, wherein each of the sheet storing trays comprises an auxiliary tray extending in a sheet ejecting direction for receiving a longer sheet.

3. The ejected sheet stacking device of claim 1, wherein the ejected sheet stacking device is mounted to an inner wall partitioning the hollow place of the image forming apparatus through a mounting opening which is formed so that a connection part of the ejected sheet stacking device to be connected is exposed, and wherein the ejected sheet stacking device further comprises a holding portion for holding a cover part for covering the mounting opening which remains opened after the ejected sheet stacking device is dismounted from the image forming apparatus.

4. The ejected sheet stacking device of claim 1, further comprising a second ejected sheet stacking device having a same structure as the ejected sheet stacking device, capable of mounting in place of a sheet storing tray corresponding to one of the bifurcation paths in the ejected sheet stacking device.

5. The ejected sheet stacking device of claim 4, wherein the hollow place comprises a first space portion downstream of the sheet ejection opening and a second space portion downstream of the first space portion in a sheet ejecting direction, and a level of a bottom surface of the second space portion is lower than a level of a bottom surface of the first space portion, and wherein the ejected sheet stacking device is mounted using the first space portion and the second ejected stacking device is mounted using the second space portion in the hollow place.

* * * * *